US005437303A

United States Patent [19]

Johnson

[11] Patent Number: 5,437,303

[45] Date of Patent: Aug. 1, 1995

[54] APPARATUS FOR CONTAINING FLUID LEAKS AND OVERFLOWS FROM APPLIANCES

[76] Inventor: Addison M. Johnson, 1346 E. Juniper Beach Rd., Camano Island, Wash. 98292

[21] Appl. No.: 251,511

[22] Filed: May 31, 1994

Related U.S. Application Data

[63] Continuation-in-part of Ser. No. 891,458, May 29, 1992, Pat. No. Des. 347,468.

[51] Int. Cl.[6] ..... E03B 7/08; F16L 55/07

[52] U.S. Cl. ..... 137/312; 4/251.1; 4/613; 4/614; 68/208; 137/360; 222/108

[58] Field of Search ..... 4/251.1, 613, 614; 52/287.1, 302.1; 68/208; 137/312, 359, 360; 222/108

[56] References Cited

U.S. PATENT DOCUMENTS

| | | | |
|---|---|---|---|
| D. 299,523 | 1/1989 | Poulin | D23/283 |
| D. 337,154 | 7/1993 | Simpson | D23/270 |
| 2,389,724 | 11/1945 | Falco | D23/283 |
| 2,952,271 | 9/1960 | Dick et al. | 137/360 |
| 3,096,781 | 7/1963 | Roidt | 137/314 |
| 3,148,698 | 9/1964 | Arnold | 137/360 |
| 3,186,427 | 6/1965 | Martin et al. | 137/343 |
| 3,263,242 | 8/1966 | Will | D23/283 |
| 3,304,950 | 2/1967 | Hubert | 137/312 |
| 3,800,335 | 4/1974 | Buonaura | 4/613 |
| 3,895,398 | 7/1975 | Mustee | 4/613 |
| 3,996,959 | 12/1976 | Caruth | 137/360 |
| 4,069,837 | 1/1978 | Jirasek | 137/360 |
| 4,410,004 | 10/1983 | Kifer et al. | 137/360 |
| 4,423,528 | 1/1984 | Wiedmeier | 4/613 |
| 4,539,721 | 9/1985 | Moore | 4/613 |
| 4,716,925 | 1/1988 | Prather | 137/360 |
| 4,765,360 | 8/1988 | Baird | 137/312 |

*Primary Examiner*—George L. Walton
*Attorney, Agent, or Firm*—Hughes Multer & Schacht

[57] ABSTRACT

An assembly for containing fluid leaking or overflowing from an appliance to a destination of waste fluid. The fluid containing assembly comprises a wall protecting member, a floor protecting member, and an overflow conduit for channeling water to the destination of waste fluid. The appliance is placed on the floor protecting member with the wall protecting member between the appliance and the wall. The wall and floor protecting members are fluid impermeable. The wall protecting member has a fluid supply orifice, a waste orifice, and a power supply orifice formed therein. The floor protecting member has an overflow orifice formed therein. The orifices in the wall protecting member and floor protecting member are arranged such that fluid leaks or overflows from the appliance are directed from the wall and floor and into the overflow conduit to the destination of waste fluid.

19 Claims, 6 Drawing Sheets

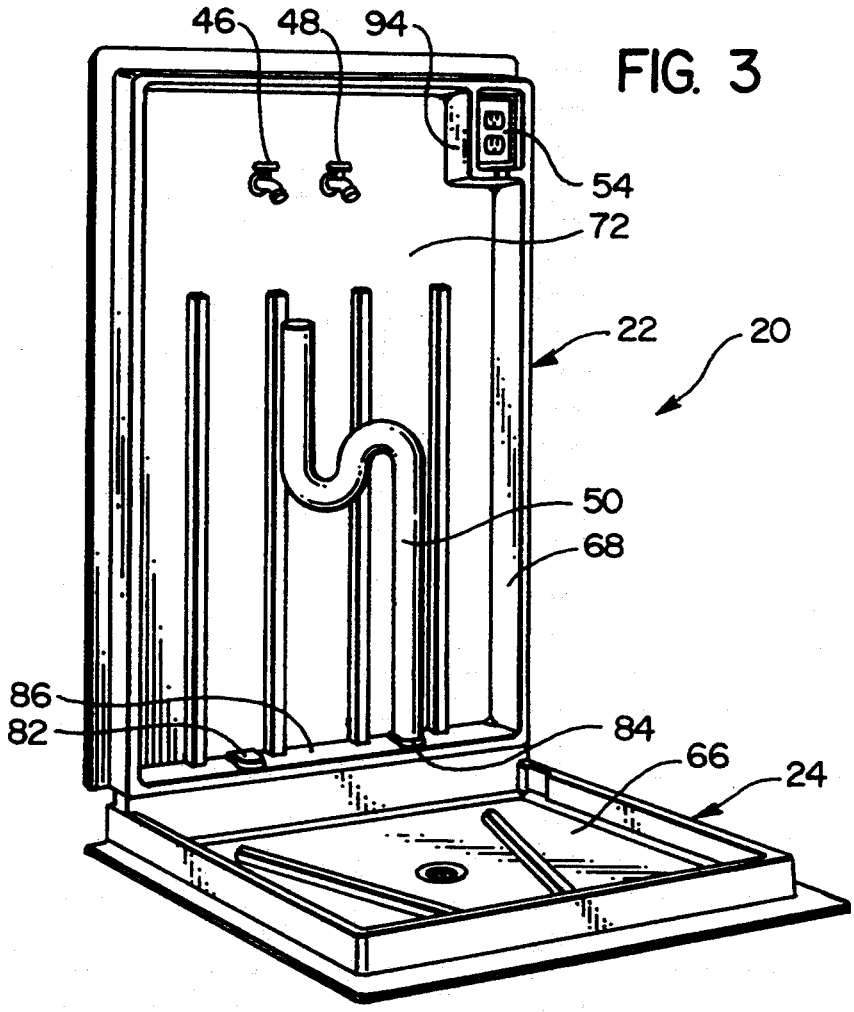
FIG. 3
FIG. 4
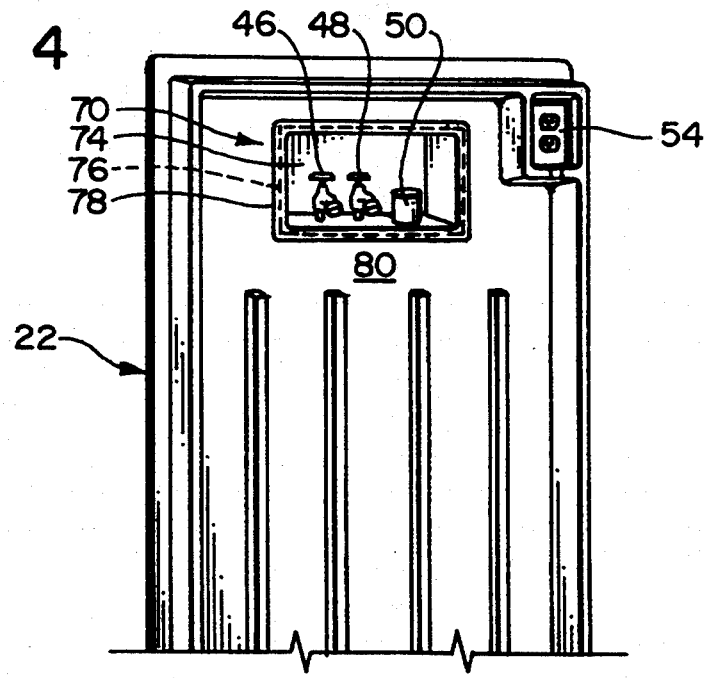

APPARATUS FOR CONTAINING FLUID LEAKS AND OVERFLOWS FROM APPLIANCES

RELATED APPLICATIONS

This application is a continuation-in-part of U.S. patent application Ser. No. 07/891,458 filed May 29, 1992, now U.S. Pat. Des. No. 347468, issued May 31, 1994, for CLOTHES WASHER INSTALLATION RECEPTACLE.

TECHNICAL FIELD

The present invention relates to apparatus for containing fluid leaks and overflows, and, more particularly, to such apparatus that channel fluids leaking or overflowing from an appliance to a destination of such waste fluids to prevent damage to the structure in which the appliance is installed.

BACKGROUND OF THE INVENTION

Household appliances such as washing machines, dish washers, refrigeraters, and hot water heaters often contain, circulate, dispense and otherwise use water while operating. Due to failed gaskets, worn seals, broken hoses, and plugged drain pipes, water used by such household appliances can leak or overflow onto the floor and walls surrounding the area in which the appliance is located. Such leaks and overflows can cause extensive damage to carpets, furniture, flooring, and personal possessions within the home; slow leaks can be even more serious, resulting in serious structural damage to the home itself.

The appliance that causes the most serious problems is the washing machine, and the present invention is particularly useful when used to contain leaks and overflows from a residential washing machine. Accordingly, the present invention will be discussed in detail herein in the context of a washing machine installed in a residential setting. However, the present invention may have broader application to other appliances and in other settings; the scope of the present invention should thus be determined by the claims appended hereto and not the following detailed description.

Washing machines are normally connected by hoses to hot and cold water supply pipes and a waste pipe and by electric cord to an electrical outlet. During operation, the washing machine goes through various cycles during which water from the supply pipes is channeled into a tub into which clothes are placed and soapy water is drained from the tub through the waste pipe. Due primarily to vibration of the washing machine, leaks can develop in the supply hoses and waste hose or the supply hoses can become disconnected. Further, washing machine tub seals and internal machine hoses and parts can break, rupture, and/or disconnect. Overflows can result from the waste hose becoming plugged or too much soap being placed into the tub. In any of these cases, gallons of water can be introduced into the area surrounding the washing machine in a matter of seconds.

As mentioned briefly above, the need thus exists for an assembly for containing fluid leaking or overflowing from a household appliance such as a washing machine.

OBJECTS OF THE INVENTION

From the foregoing, it should be clear that a general object of the present invention is to provide improved assemblies for containing fluid leaks and overflows from household appliances such as washing machines.

Another more specific object of the present invention is to provide fluid containment assemblies having a favorable mix of the following characteristics:

a. may be easily, flexibly, and inexpensively installed in new installations or as a retrofit;
b. does not cause a washing machine to, walk, rotate, or twist during its spin cycle in a manner that causes leaks to occur; and
c. can be inexpensively manufactured and shipped.

SUMMARY OF THE INVENTION

The above and other objects are achieved by an assembly for containing fluid leaks and overflows from an appliance to which a fluid supply conduit, a fluid waste conduit, and a power supply outlet are operatively connected, the assembly comprising: (a) a wall protecting member arranged between the appliance and a wall against which the appliance is mounted, where the wall protecting member is fluid impermeable and has at least one orifice through which the fluid supply conduit, fluid waste conduit, and power supply outlet extend; (b) a floor protecting member arranged between the appliance and a floor on which the appliance is mounted, where the flood protection member is fluid impermeable and has an overflow orifice formed therein; and (c) a fluid overflow conduit connected between the overflow orifice and a destination of waste fluid.

When the appliance is a washing machine, the wall protecting member may comprise: (a) at least one fluid supply orifice through which the fluid supply conduit extends, (b) at least one waste orifice through which the fluid waste conduit extends, and (c) at least one power supply orifice through which the power supply outlet extends.

As will be discussed in further detail below, the present invention may be easily, flexibly, and inexpensively installed in a new installations or as a retrofit. Further, the disclosed structure maintains a flat surface on which the washing machine sits. This inhibits walking or rotation of the washing machine during its spint cycle. The present invention can be easily and inexpensively manufactured and shipped.

These and other features of the present invention will become clear from the following detailed discussion of the invention.

BRIEF DESCRIPTION OF THE DRAWING

FIGS. 3 and 4 are perspective views showing two common installation configurations of the assembly shown in FIG. 1;

DETAILED DESCRIPTION OF THE INVENTION

Figure 1:
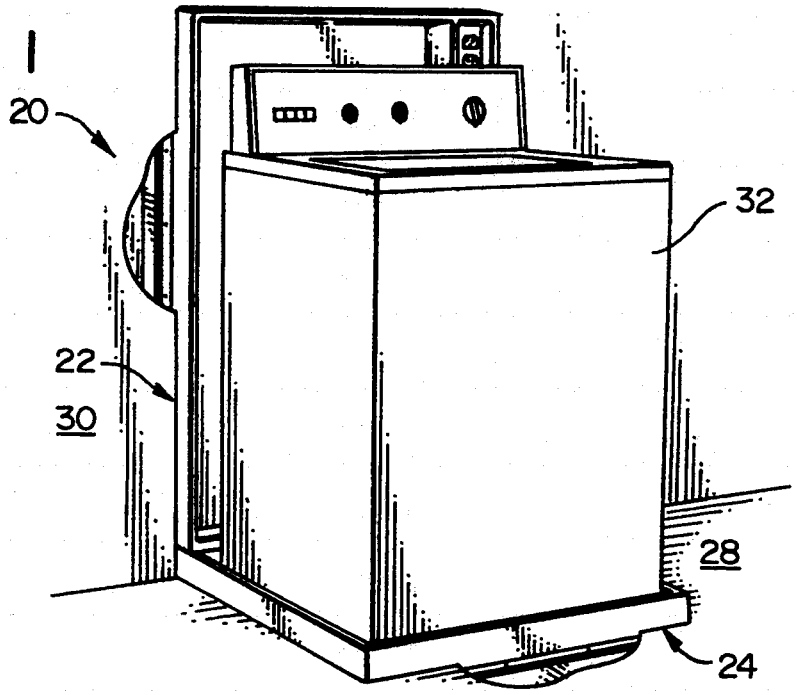
FIGS. 1 is a perspective view of a fluid containment assembly constructed in a accordance with, and embodying, the principles of the present invention.
Figure 5:
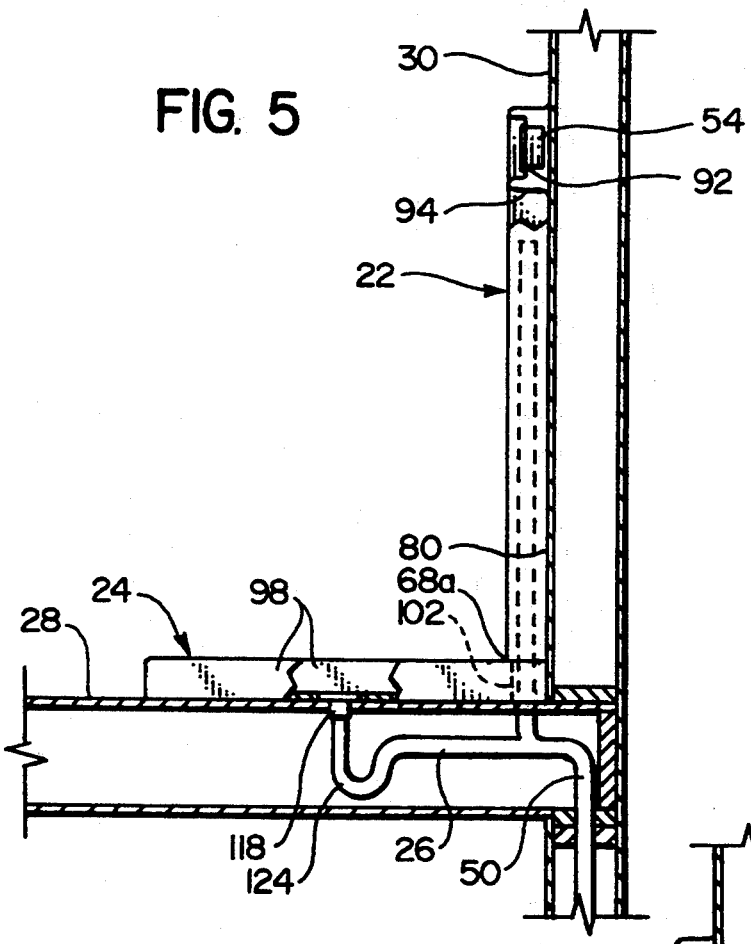
FIGS. 5 and 6 are side, plan, cutaway views depicting the overflow conduit of the assembly shown in FIG. 1.

Referring now to FIG. 1, depicted at 20 therein is a fluid containment assembly constructed in accordance with, and embodying, the principles of the present invention. This fluid containment assembly 20 basically comprises a wall protecting member 22 and a floor protecting member 24. Further, as shown in FIG. 5, an overflow conduit 26 is connected between the wall protecting member 22 to safely dispose of waste fluid on the floor protecting member 24.

The floor protecting member 24 is placed on a floor 28, and the wall protecting member is arranged against a wall 30. An appliance 32, in this case a washing machine, is placed on the floor protecting member 24 such that the floor protecting member 24 is between the appliance 32 and the floor 28 and the wall protecting member 22 is between the appliance 32 and the wall 30.

The assembly 20 operates basically as follows. As is well-known in the art, a washing machine such as the appliance 32 employs water to wash and rinse clothing. As will be discussed in further detail below, hoses and drain pipes connected to the appliance 32 carry fluids between the appliance 32 and sources and destinations of such fluids. Such hoses and drain pipes are normally located between the appliance 32 and the wall 28. Should fluids leak out of hoses attached to the applicance 32 or leak or overflow from the appliance 32 itself, the fluid containment assembly 20 will contain this fluid and direct it to the overflow conduit 26 for proper disposal.

In particular, water dripping from or running down the side of the appliance 32 will be contained by the floor protecting member 24 and directed into the overflow conduit 26. Pressurized water leaking from the appliance 32 or hoses connected thereto will be contained by the wall protecting member 22 and, as will be explained further below, be directed onto the floor protecting member 24 and thus into the overflow conduit 26. It should be noted that the term "leaking or overflowing from the appliance" is used herein to refer to fluid leaking from sources related to the appliance 32 as well as fluid leaking directly from the appliance 32 itself.

The fluid containment assembly 20 will thus contain and properly dispose of water leaking or overflowing from the appliance 22. The water contained and disposed of by the assembly 20 will thus not damage the wall 28 or floor 30 or any other items on or near the wall 28 or floor 30.

Figure 10:
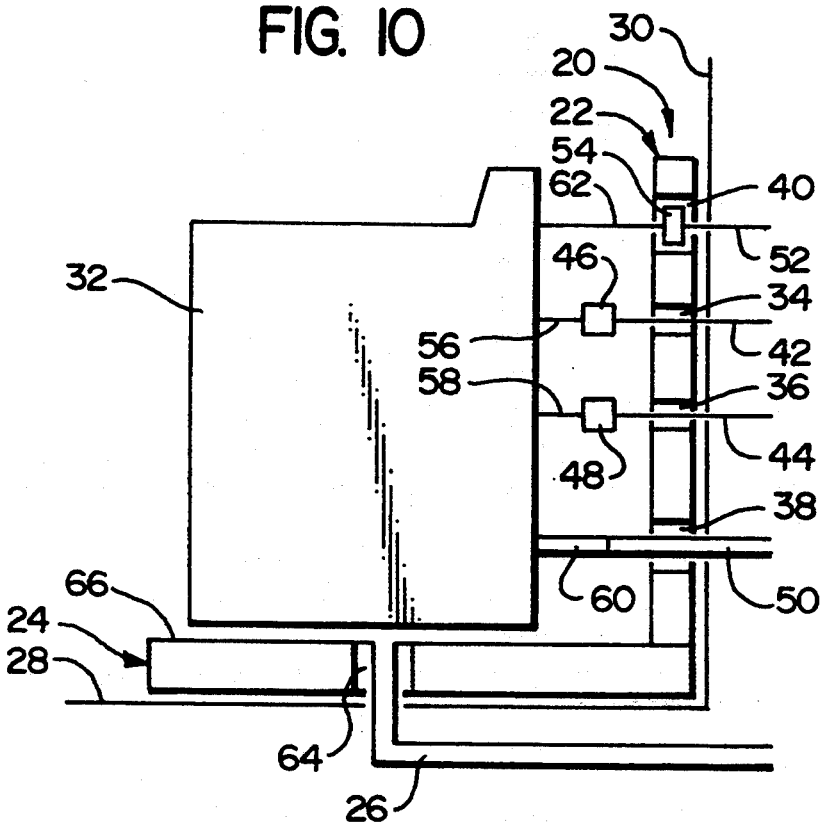
FIG. 10 is a highly schematic view of the fluid containment assembly depicted in FIG. 1.

Referring now to FIG. 10, depicted therein is a highly schematic representation of the fluid containment assembly 20 in a typical installation. In FIG. 10, the fluid containment assembly 20, wall protecting member 22, floor protecting member 24, overflow conduit 26, wall 28, floor 30, and apliance 32 are all depicted and identified by their assigned reference characters.

FIG. 10 also shows that first and second fluid supply orifices 34 and 36, a waste orifice 38, and a power supply orifice 40 are formed in the wall protecting member 22. Extending through the first and second supply orifices 34 and 36 are hot and cold water pipes 42 and 44 which terminate in hot and cold water faucets 46 and 48. A fluid waste pipe 50 extends through the waste orifice 38. An electrical conductor 52 is connected to a power outlet 54 mounted in the power supply orifice.

Hot and cold water hoses 56 and 58 are connected between the hot and cold water faucets 46 and 48, respectively, and the appliance 32. A drain hose 60 through which waste fluid from the appliance 32 flows in connected to the fluid waste pipe 50. An appliance power cord 62 is plugged into the power outlet 54 to provide electrical power to the appliance 32. The operations of connections to the appliance 32 are well-known and will not be described herein in further detail.

An overflow orifice 64 is formed in the floor protecting member 24. The overflow conduit 26 extends through the overflow orifice 64 such that fluid on an upper surface 66 of the floor protecting member 24 enters the overflow conduit 26.

The construction, features, and operation of the fluid containment assembly 20 will now be described in further detail with reference to the remaining Figures of the drawing.

Figure 2:
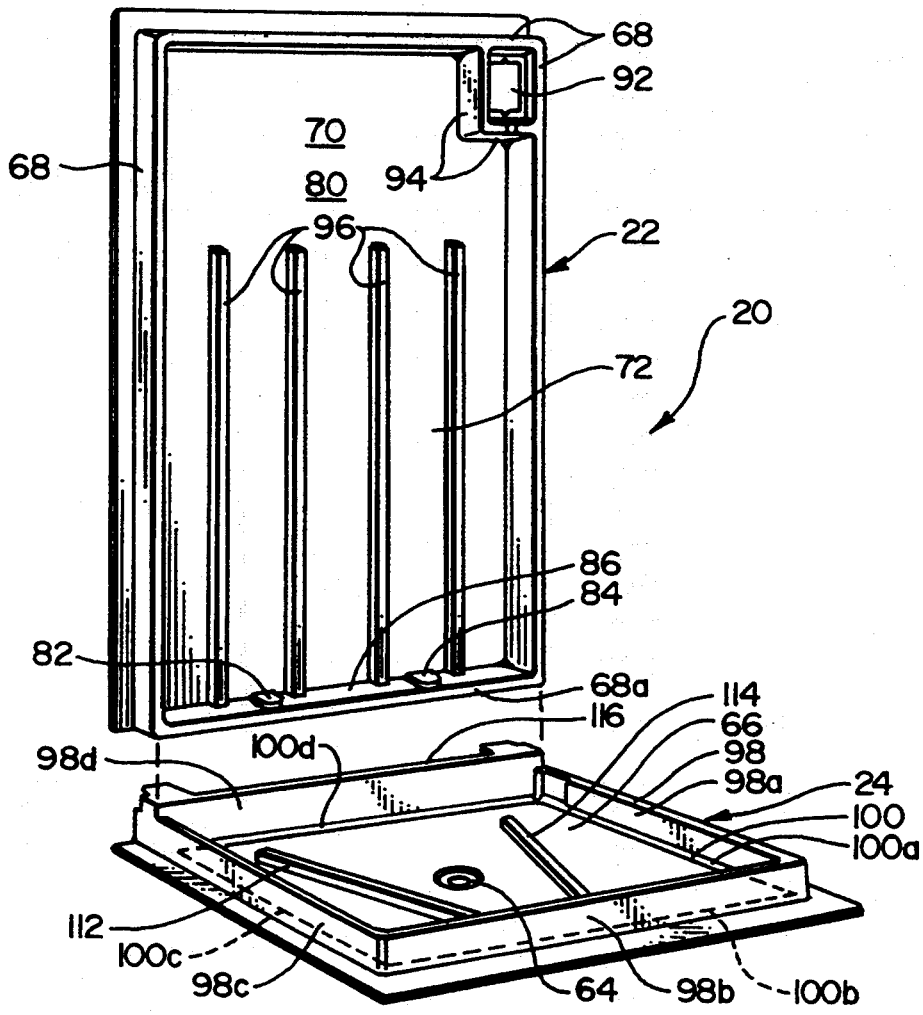
FIG. 2 is a perspective view depicting the wall protecting member and the floor protecting member of the assembly shown in FIG. 1.
Figure 9:
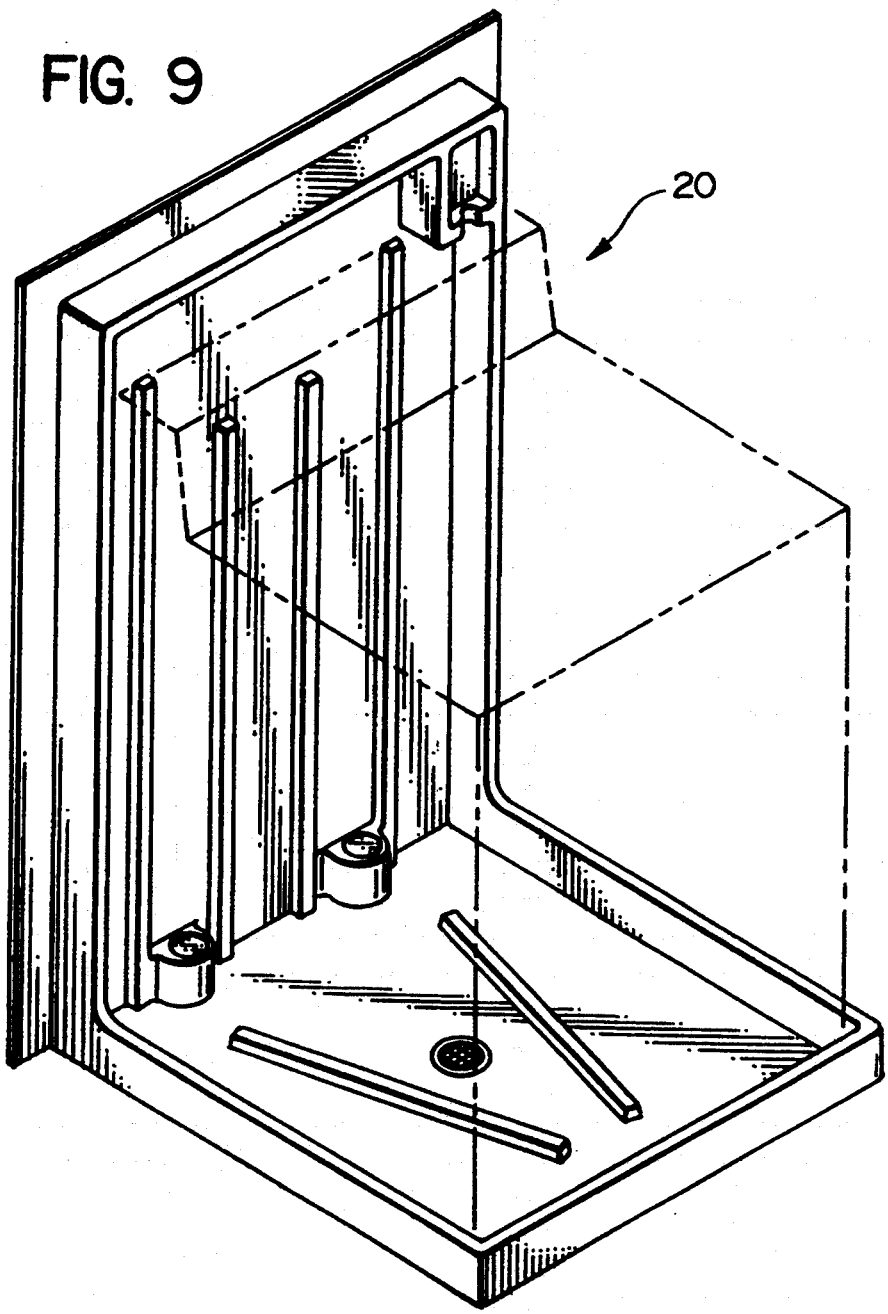
FIG. 9 is an alternative embodiment of the present invention in which the wall and floor protecting members are formed of a single sheet of material.

Referring initially to FIG. 2, it can be seen that the exemplary wall protecting member 22 and floor protecting member 24 are separate pieces. The use of two separate members 22 and 24 allows the fluid containment assembly 20 to manufactured and shipped more easily and inexpensively. However, as shown in FIG. 9 and discussed in further detail below, the present invention operates just as effectively with a one-piece design.

The exemplary protecting members 22 and 24 are each comprised of a single sheet of high-density polyethylene (HDPE) formed into an appropriate shape using a vacuum molding process. The wall protecting member 22 preferably has a minimum thickness of 0.125", while the floor protecting member preferably has a minimum thickness of 0.187".

HDPE is water impermeable and well-suited to the formation of the protecting members 22 and 24, but other materials such as fiberglass, ceramics, and metal can be used as long as the material is water impregnable. The use of two single sheets results in only one juncture where fluid can leak possibly leak out of the fluid containment assembly 20.

A splash guard 68 extends around the peripheral edge of the wall protecting member 22. A fluid supply region 70 is located in an upper portion of the wall protecting member 22 and is surround on its upper and side edges by the splash guard 68. The fluid supply region 70 is unreinforced, and the fluid supply orifices 34 and 36 are formed therein at the installation site. As shown in FIGS. 3 and 4, the exact location of the fluid supply orifices 34 and 36 is determined by the installer according to the needs of the particular installation; this eliminates the need for the installer to plumb to preconfigured perforations, thereby reducing the cost and complexity of the installation.

As shown in FIG. 3, the installer will preferably form separate fluid supply orifices 34 and 36 to accomodate the hot and cold water pipes 42 and 44 from which water for use by the appliance 22 is obtained. Thus, if the faucets 46 and 48 or hoses 56 and 58 connected thereto begin to leak, the water will fall directly onto the upper surface 66 of the floor protecting member 24 or spray against a front surface 70 of the wall protecting member 22 and then flow onto the floor member upper surface 66. In either case, the water will be channeled to the overflow conduit 26 for proper and safe disposal.

FIG. 4 shows that the fluid containment assembly 20 can accommodate an in-wall plumbing box 74 such as is used in many residences. In this case, a single opening 76 is formed in the fluid supply region 70. A flange 78 of the plumbing box 74 overlaps a front surface 80 of the wall protecting member 24 around the opening 76. The hot and cold water faucets 46 and 48 and the drain pipe 50 extend into the plumbing box 74.

While the plumbing box 74 can be accomodated, the situation shown in FIG. 3 is preferable becauses it lessens the chances that water will get into the wall should a leak occur at the faucets 46 and 48 and the drain pipe 50.

A pair of waste orifice platforms 82 and 84 are formed in a bottom edge 86 of the splash guard 68. As illustrated in FIG. 3, the waste orifice 38 is formed in one of the platforms 74 and 76, in this case the platform 84, to allow passage of the drain pipe 50. Again, the waste orifice 38 is formed at the job site to provide maximum flexibility to the installer.

Figure 7:
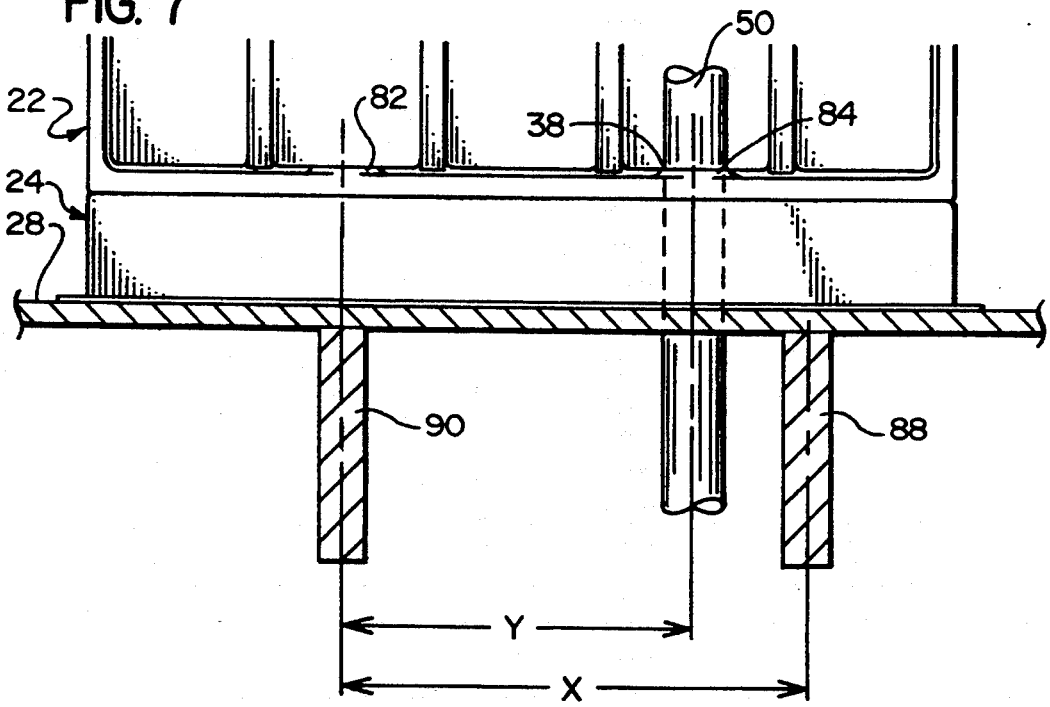
FIG. 7 is a front, plan, cut-away view showing details of the arrangement of drain platforms employed by the assembly shown in FIG. 1.

Two waste orifice platforms 82 and 84 are formed to eliminate the possbility that waste orifice 38 is formed over a floor joist. Referring to FIG. 7, it can be seen that floor joists 88 and 90 are spaced a distance X, usually 16" o.c., from each other. The waste orifice platforms 82 and 84, however, are spaced a shorter distance Y, in this case 12", from each other. Thus, even though the waste orifice platform 82 is over the joist 90, the waste orifice 38 may be formed in the waste orifice platform 84 between the joists 88 and 90. The waste pipe 50 thus can pass between the joists 88 and 90 as it extends through the waste orifice 38.

A socket surface 92 is formed on an upper corner of the wall protecting member 22. The power supply outlet 54 is mounted on the socket surface 92 to allow access to the socket 54 from the front of the wall protecting member 22. The socket surface 92 is bounded on two sides by the splash guard 68 and on two sides by a power supply dam 94. Therefore, as shown in FIG. 3, the socket surface 92, and thus the outlet 54, is recessed back such that any water sprayed by the faucets 46 and 48 will not reach the outlet 54.

A plurality of reinforcing ribs 96 extend vertically through the lower and middle portions of the wall protecting member 22 to the bottom of the fluid supply region 70. These reinforcing ribs 96 thus provide rigidity to the wall protecting member 22 but do not interfere with the formation of the fluid supply and waste orifices 34, 36, and 38.

A fluid dam 98 extends around a peripheral edge 100 of the floor protecting member 24. This fluid dam 98 contains fluid on the upper surface 66 of the floor protecting member 22 and causes fluid thereon to enter the overflow conduit 26.

Figure 8:
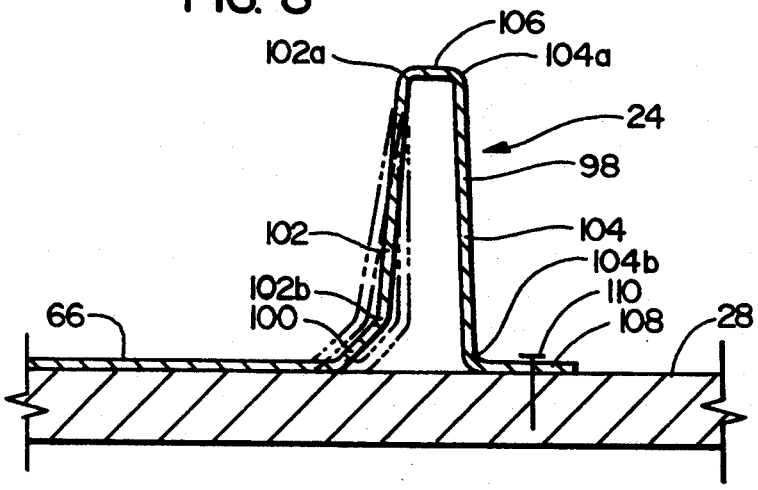
FIG. 8 is a plan, cut-away view showing the floating of the floor protecting member shown in FIG. 2.

As is best shown in FIG. 8, the dam 98 comprises an inner portion 102, an outer portion 104, an upper portion 106, and a lower portion 108. The upper portion 106 is connected between upper edges **102*a* and 104*a* of the inner and outer portions 102 and 104. A lower edge 102*b* of the inner portion 102 is connected to the peripheral edge 100 of the floor protecting member 24. The lower portion 108 is connected to a lower edge 104*b* of the outer portion 104**.

The lower portion 108 is fastened to the floor 30 at intervals using nails 110. These nails 110 anchor the floor protecting member 24 to the floor; however, as shown by dot-dashed lines in FIG. 8, the structure of the dam 98 described herein allows the floor protecting member 24 to expand and contract without buckling. This expansion and contraction of the floor protecting member 24 will be referred to as floating.

The floating of the floor protection member 24 ensures that this member 24 is flat and does not buckle under all environmental conditions. When the appliance 32 is a washing machine as shown and described in FIGS. 1 and 10, keeping the floor protecting member 24 flat helps prevent the washing machine from walking, and in particular twisting, during its spin cycle. This prevents strain on the hoses 56, 58, and 60 leading to the washing machine 32 and the leaks that might result from this strain.

Further, the reduction of buckling reduces the chance that leaked fluids will puddle up on the upper surface 66 of the floor protection member 24. When such puddling is allowed to occur, the fluids attract dust and dirt which builds up over time and becomes a source of dust within the home. Keeping the floor protection member 24 flat thus reduces the tendency for dirt to build up on the upper surface 66. Also, reducing the build up of dirt on the upper surface 66 will reduce the tendency for a vigorous overflow to wash this dirt through the overflow orifice 64 where it might plug the overflow conduit 26.

Referring for a moment back to FIG. 2, it can be seen that two reinforcing ribs 112 and 114 are formed in the floor protecting member 24. As with the ribs 96 described above, these ribs 112 and 114 will provide rigidity to floor protecting member 24.

Further, these reinforcing ribs 112 and 114 are angled with respect to each of the side portions **100*a*, 100*b*, 100*c*, and 100*d* of the preipheral edge 100. By angling these reinforcing ribs 112 and 114 with respect to the portions 100*a*–*d* of the peripheral edge 100, these ribs 112 and 114 tend to counteract buckling of the floor protecting member 24. If these ribs 112 and 114 were not so angled, the floor protecting member 24 could easily buckle along a line parallel to the ribs 112 and 114** and actually raise the entire rib as it buckled.

A back portion **98*d* of the fluid dam 98 is slightly raised relative to right side, front, and left side portions 98*a*, 98*b*, and 98*c* of this dam 98. Further, a notch or cut-out 116 is formed in this back portion 98*d*. At this notch or cut-out 116, the outer and lower portions 104 and 108 of the dam are removed. The notch 116 accommodates the waste pipe 50** without cutting.

The spray guard 68 engages the back portion **98*d* of the fluid dam 98 when the fluid containment assembly 20 is assembled. Further, as shown best in FIGS. 5 and 6, a bottom edge 68*a* of the spray guard 68 extends forward of the fluid dam back portion inner wall 102 such that water traversing down the front surface 80 of the wall protecting member 22 flows onto the upper surface 66 of the floor protecting member 24**.

Figure 6:
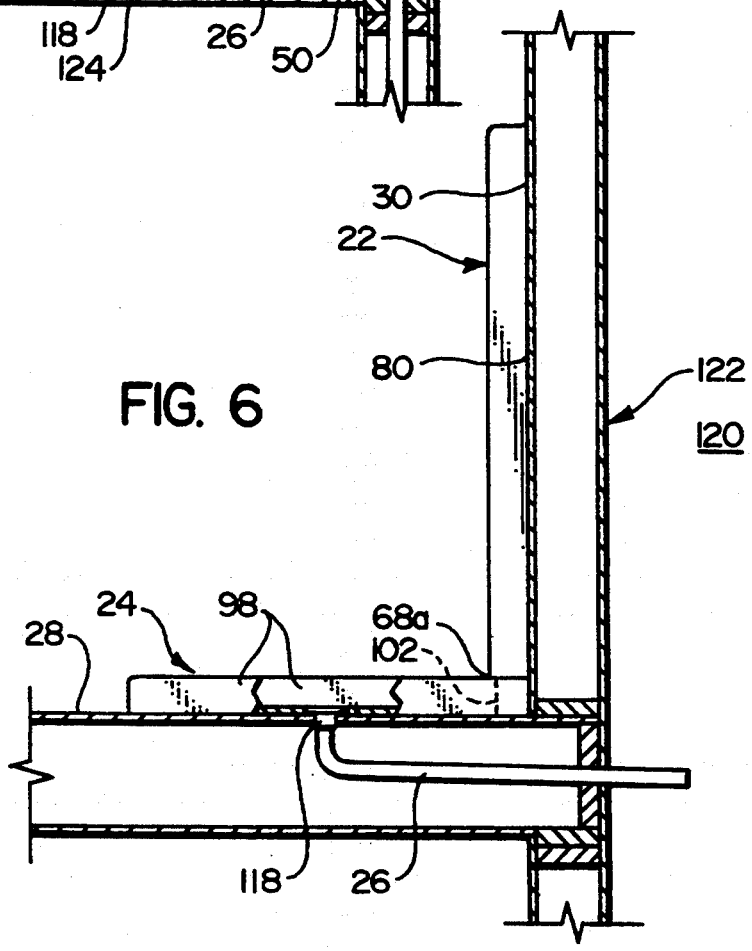

The overflow orifice 64 is centrally located in the floor protecting member 24. As shown in FIGS. 5 and 6, the overflow conduit 26 is connected to the floor protecting member 64 at the overflow orifice 64 using a standard shower drain 118.

The overflow conduit 26 itself can be a straight pipe to an exterior 120 of a structure 122 formed by the walls 28 and floor 30° Since overflow conduit 26 will only be used in emergencies and the fluids collected by the overflow conduit 26 will normally be soap and water, a simple straight pipe as shown in FIG. 6 will be simple, safe, and effective.

In other cases, lack of an easy path to the exterior, local codes, or other factors may require that the overflow conduit 26 be connected to the sewer system through the drain pipe 50. In this case, as shown in FIG. 5, a P-trap 124 should be formed in the overflow conduit 26 between the shower drain 118 and the drain pipe 150.

With the structure described above, water will traverse down the wall protecting member 22, be collected in the floor protecting member 24, and then flow into the overflow conduit 26 for appropriate disposal. Referring now to FIG. 9, it can be seen that the wall and floor protecting units can easily be formed in as a single unit rather than with two separate members. A single peice unit such as that shown in FIG. 9 would operate just as effectively as the two peice unit shown in FIGS. 1–8 and 10; however, the single piece version cannot be manufactured or shipped as easily as the two peice version.

From the foregoing, it should be clear that the present invention may be embodied in forms other than described above. The above-described embodiments are therefore to be considered in all respects illustrative and not restrictive, the scope of the invention being indicated by the appended claims rather than the foregoing description. All changes that come within the meaning and scope of the claims are intended to be embraced therein.

I claim:

1. An assembly for containing fluid leaks and overflows from an appliance to which a fluid supply conduit, a fluid waste conduit, and a power supply outlet are operatively connected, comprising:

a. a wall protecting member arranged between the appliance and a wall against which the appliance is mounted, where the wall protecting member is fluid impermeable and has at least one orifice through which the fluid supply conduit, fluid waste conduit, and power supply outlet extend and mounted therein; and b. a floor protecting member arranged between the appliance and a floor on which the appliance is mounted, where the floor protection member is fluid impermeable and has an overflow orifice formed therein to allow fluid to drain from the floor protecting member to a destination of waste fluid, wherein the wall protecting member being positioned and mounted relative to the floor protecting member, thereby allowing any fluid leakage and overflow from the fluid supply conduit and the fluid waste conduit to fall into the floor protecting member.

2. A fluid containing assembly as recited in claim 1, further comprising a fluid overflow conduit connected between the overflow orifice and the destination of waste fluid.

3. A fluid containing assembly as recited in claim 2, in which the wall protecting member comprises:

a. at least one fluid supply orifice through which the fluid supply conduit extends, b. at least one waste orifice through which the fluid waste conduit extends, and c. at least one power supply orifice through which the power supply outlet extends.

4. A fluid containing assembly as recited in claim 3, in which the wall protecting member further comprises a power supply dam located between the power supply orifice and the fluid supply orifice in a manner that blocks movement of fluid from the fluid supply conduit to the power supply outlet.

5. A fluid containing assembly as recited in claim 3, in which the at least one fluid supply orifice is formed in a supply orifice region located on an upper portion of the wall protecting member.

6. A fluid containing assembly as recited in claim 1, in which an upper surface of the floor protecting member is substantially level.

7. A fluid containing assembly as recited in claim 1, in which a peripheral dam extends around the periphery of the floor protecting member to contain fluid on an upper surface of the floor protecting member.

8. A fluid containing assembly as recited in claim 7, in which at least a portion of the peripheral dam comprises:

a. inner and outer portions each having a lower edge and an upper edge, where the lower edge of the inner portion is connected to a peripheral edge of the floor protecting member;

b. an upper portion connected between the upper edges of the inner and outer portions; and c. a lower horizontal portion connected to the lower edge of the outer portion, wherein the lower horizontal portion is secured to the floor and the floor protecting member is not connected to the floor.

9. A fluid containing assembly as recited in claim 1, in which peripheral edges of the floor protecting member are arranged in a rectangular configuration, and the floor protecting member further comprises at least one reinforcing rib that is angled with respect to each of peripheral edges of the floor protecting member.

10. A fluid containing assembly as recited in claim 1, in which a splash guard extends around the periphery of the wall protecting member to contain fluid on a front surface of the wall protecting member.

11. A fluid containing assembly as recited in claim 10, in which a lower portion of the splash guard extends over at least a portion of the peripheral edge of the floor protecting member such that the splash guard directs fluid traversing down a front surface of the wall protecting member onto an upper surface of the floor protecting member.

12. A fluid containing assembly as recited in claim 11, in which the fluid waste orifice is formed in one of two waste orifice platforms formed on the lower portion of the splash guard.

13. A fluid containing assembly as recited in claim 12, in which the two waste orifice platforms are spaced from each other a distance that is not equal to a distance between two joists in the floor.

14. A fluid containing assembly as recited in claim 1, in which at least one reinforcing rib is formed in the wall protecting member.

15. An assembly for containing fluid leaks and overflows from an appliance to which a fluid supply conduit, a fluid waste conduit, and a power supply outlet are operatively connected, comprising:

a. a rectangular wall protecting member arranged between the appliance and a wall against which the appliance is mounted, where the wall protecting member is fluid impermeable comprises a splash guard extending around a periphery thereof and i. at least one fluid supply orifice through which the fluid supply conduit extends is formed in an upper portion of the wall protecting member, ii. at least one waste orifice through which the fluid waste conduit extends is formed in a lower portion of thesplash guard, and iii. at least one power supply orifice through which the power supply outlet extends is formed on an upper portion of the wall protecting member adjacent to the splash guard;

b. a rectangular floor protecting member arranged between the appliance and a floor on which the appliance is mounted, where the flood protection member is fluid impermeable and has an overflow orifice formed therein through which fluid on an upper surface of the floor protecting member flows; and c. fluid overflow conduit connected between the overflow orifice and a destination of waste fluid to channel fluid flowing through the overflow orifice to the destination 0f waste fluid, wherein the wall protecting member being positioned and mounted relative to the floor protecting member, thereby allowing any fluid leakage and overflow from the fluid supply conduit and the fluid waste conduit to fall into the floor protecting member.

16. A fluid containing assembly as recited in claim 15, in which the upper surface of the floor protecting member is substantially level.

17. A fluid containing assembly as recited in claim 16, in which a peripheral dam extends around the periphery of the floor protecting member and at least a portion of the peripheral dam comprises:

a. inner and outer portions each having a lower edge and an upper edge, where the lower edge of the inner portion is connected to a peripheral edge of the floor protecting member;

b. an upper portion connected between the upper edges of the inner and outer portions; and c. a lower horizontal portion connected to the lower edge of the outer portion, wherein the lower horizontal portion is secured to the floor and the floor protecting member is not connected to the floor.

18. A fluid containing assembly as recited in claim 17, in which the wall protecting member further comprises a power supply dam located between the power supply orifice and the fluid supply orifice in a manner that blocks movement of fluid from the fluid supply conduit to the power supply outlet.

19. A fluid containing assembly as recited in claim 18, in which two waste orifice platforms are formed in a lower portion of the splash guard and are spaced from each other a distance that is not equal to a distance between two joists in the floor.

* * * * *